United States Patent [19]

Watson et al.

[11] Patent Number: 4,799,720

[45] Date of Patent: Jan. 24, 1989

[54] GRAVITY-OPERATED GATE LATCH APPARATUS

[76] Inventors: John P. Watson, 107 Mile Dr., College Station, Tex. 77840; William P. Graff, 1809 Groesbeck, Bryan, Tex. 77803

[21] Appl. No.: 58,596

[22] Filed: Jun. 1, 1987

Related U.S. Application Data

[63] Continuation of Ser. No. 768,237, Aug. 22, 1985, abandoned.

[51] Int. Cl.[4] ..... E05C 21/02

[52] U.S. Cl. ..... 292/299

[58] Field of Search ..... 292/148, 205, 299, 300, 292/302

[56] References Cited

U.S. PATENT DOCUMENTS

| | | | |
|---|---|---|---|
| 782,091 | 2/1905 | Whitcomb et al. | 292/148 X |
| 830,327 | 9/1906 | Johnston | 292/299 |
| 890,660 | 6/1908 | Kent | 292/299 |
| 970,345 | 9/1910 | Munsinger et al. | 292/299 |
| 1,090,969 | 3/1914 | Browning | 292/205 X |
| 1,216,034 | 2/1917 | Williams | 292/299 |
| 1,795,402 | 3/1931 | Mevis | 292/299 |
| 1,821,847 | 9/1931 | Polaire | 292/299 |
| 2,107,066 | 2/1938 | Weddle | 292/299 |
| 2,545,038 | 3/1951 | Kingdon | 292/299 |
| 2,609,223 | 9/1952 | Adams | 292/299 |
| 2,838,334 | 6/1958 | Cornwell, Jr. et al. | 292/299 |
| 4,387,916 | 6/1983 | Lening et al. | 292/205 X |

*Primary Examiner*—Richard E. Moore

*Attorney, Agent, or Firm*—Dodge, Bush & Moseley

[57] ABSTRACT

In accordance with illustrative embodiments of the present invention, a gate latch apparatus includes a frame having spaced side members, a ring pivotally mounted between the side members, and means to limit outward swinging of the ring. A support rigidly secured with respect to the frame has a horizontal portion and an inclined portion to aid the user in positioning a latch bar on the horizontal portion where operation of the latch is assured. The bar causes the ring to swing inwardly during closure, and the ring drops downward upon passage of the bar to latch the gate closed. To release the latch, the ring is lifted to enable the bar to be removed from the support.

16 Claims, 1 Drawing Sheet

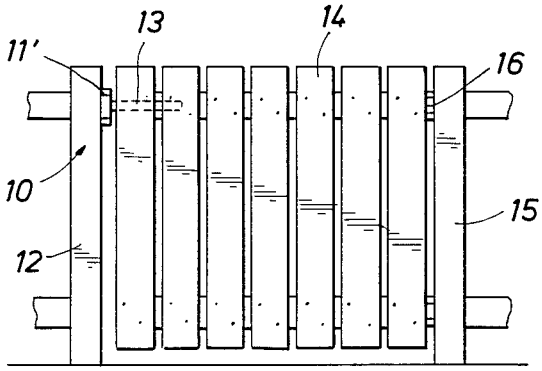
FIG. 1
FIG. 4A
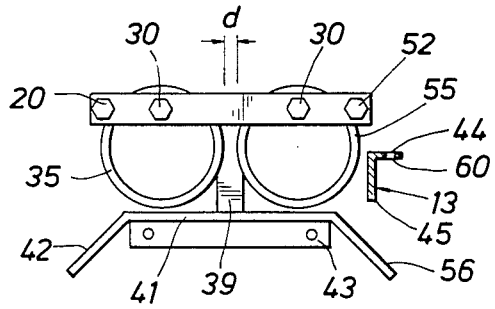
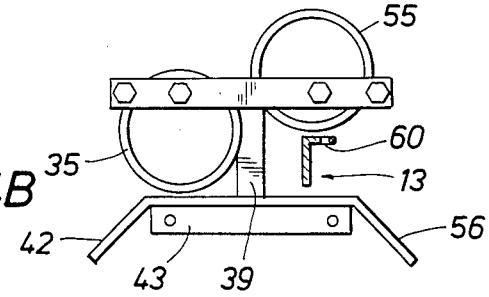
FIG. 4B
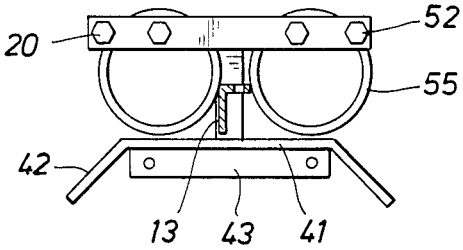
FIG. 4C
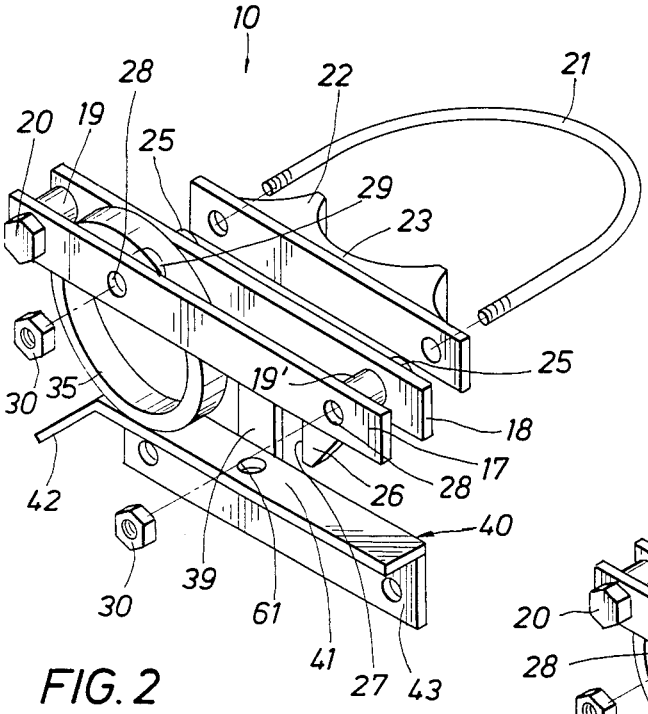
FIG. 2
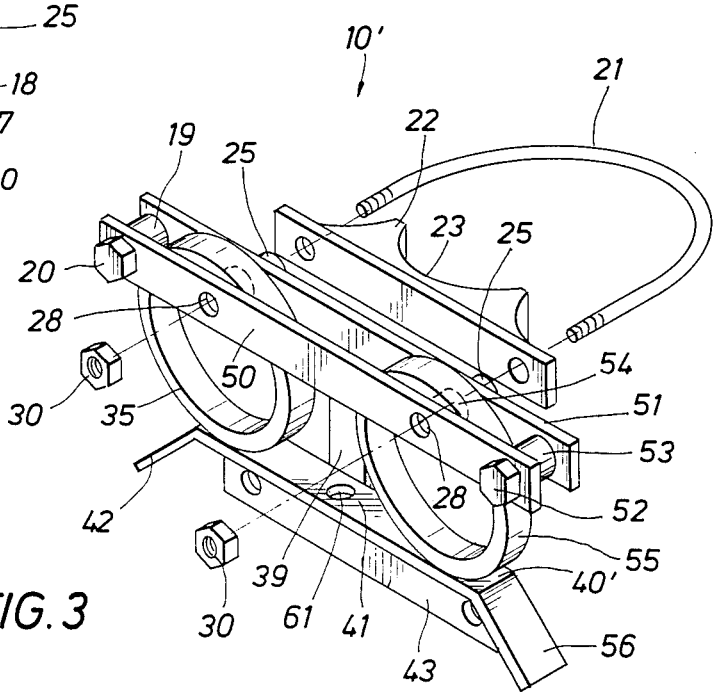
FIG. 3

GRAVITY-OPERATED GATE LATCH APPARATUS

This application is a continuation of application Ser. No. 768,237, filed 8/22/85 now abandoned.

FIELD OF THE INVENTION

This invention relates generally to gate latches, and specifically to a new and improved gravity-operated latch apparatus that includes a support member which ensures proper latching action of a bar with a keeper mechanism, particularly where the gate has sagged, or where any other condition has occurred that normally would produce improper alignment.

BACKGROUND OF THE INVENTION

Gravity operated gate latches are known. See, for example, U.S. Pat. No. 830,327, Johnston, issued Sept. 4, 1906, U.S. Pat. No. 890,660, Kent, issued June 16, 1908, and U.S. Pat. No. 1,821,847, Polaire, issued Sept. 1, 1931. These latch systems generally include a ring that is pivoted to frame on the gate post in a manner such that the ring can swing freely inward, but is restrained against outward movement. A latch bar on the gate forces the ring upward as the gate is closed, after which the ring drops down in front of the bar under the influence of gravity to trap the latch bar. A frame that pivotally mounts two rings can be used to enable the gate to swing open in the outward or the inward direction. In either case the latch is released by manually lifting a ring upward to disengage it from the latch bar.

Prior gate latches of the type described above are considered to have a number of shortcomings. For example, many of the prior systems are rather complicated structurally, and consequently would be expensive to manufacture and not cost-effective. Other systems, although simplified, have the disadvantage that should the gate sag so that the latch bar engages a lower point on the periphery of the keeper ring, the bar itself can lift the ring and cause the gate open if subjected to even a small open force due to wind or being bumped by an animal or the like. Of course, if gate sag is extensive (which often occurs with the passage of time) the bar may not engage the keeper ring at all, so that the latch system becomes useless.

The general object of the present invention is to provide a new and improved gravity-operated latch system of the type described.

A more specific object of the present invention is to provide a new and improved pivoted ring-type gate latch apparatus that includes a support that is located a predetermined distance below the pivot point of the ring to ensure operability of the latch, even where gate sag has occurred.

Another object of the present invention is to provide a new and improved gravity-operated latch system for gates and the like which is relatively inexpensive to manufacture, and is simple, reliable and fool-proof in operation.

SUMMARY OF THE INVENTION

These and other objects are attained in accordance with the concepts of the present invention through the provision of a latch system for swinging gates, or equivalent structures, comprising a frame adapted to be mounted on a gate post and including a pair of spaced members, a keeper ring pivotally mounted and carried between these members, and means for limiting outward swinging of the ring. A latch bar that is secured to the gate is arranged to engage the ring during closing movement and to lift it upward so that the bar can pass the ring and engage a stop. The ring automatically drops down in front of the bar, and a limiting means is operable to prevent outward swinging of the ring to latch the gate closed. In a preferred embodiment the latch bar has a vertical dimension that is not substantially less than the radius of the ring to provide an improved latching action, and a width that provides strength against bending as well as preventing any substantial amount of lateral play.

The latch system further includes a support means that is located below the pivot point of the ring a distance that preferably is substantially equal to the outer diameter of the ring. The support means has a horizontal portion directly below the ring, and an inclined portion that extends from the outer edge of the horizontal portion downwardly and outwardly. If the gate has sagged to any appreciable extent with the passage of time, the latch bar will engage the inclined portion and be ramped upward onto the horizontal portion where it will pass the ring and be trapped thereby. The vertical height of the bar is such that it is practically impossible for the latch to be inadvertently opened when the bar is resting on the horizontal portion of the support.

A locking feature also is provided to enable the latch system to be locked closed by a typical padlock.

An alternative embodiment of the present invention comprises a pair of keeper rings to enable the gate to be opened in either the inward or the outward direction. In this embodiment the support means has inclined ramp portions at the opposite ends of an elongated horizontal central portion.

BRIEF DESCRIPTION OF THE DRAWINGS

The present invention has other objects, features, advantages and uses which will become more clearly apparent in connection with the following detailed description of preferred embodiments, taken in conjunction with the appended drawings in which:

FIG. 1 is a front elevation of a gate having the latch system of the present invention;

FIG. 2 is an isometric view of a single action latch in accordance with the present invention;

FIG. 3 is an isometric view of a double action latch system of the present invention which permits the gate to be opened outward or inward; and FIGS. 4A–4C are front views of the latch of FIG. 2 showing its operational sequence.

DETAILED DESCRIPTION OF PREFERRED EMBODIMENTS

Referring initially to FIG. 1, a gate latch apparatus that is constructed in accordance with the principles and concepts of the present invention is shown generally at 10. A keeper system 11 is mounted in a secure manner to the outer face of the post 12, and cooperates with a latch bar 13 that is securely fastened to the gate 14. Of course the gate 14 is mounted for swinging movement on the opposite post 15 by a pair of hinges 16.

As shown in FIG. 2, a single action latch system 10 includes a pair of side members 17, 18 that are spaced apart to provide an elongated slot. The members can be separate bars as shown, or in the alterntaive can be a single bar bent into bights on its opposite ends. Tubular spacers 19, 19' are provided to fix the width of the slot to a precise distance, and a bolt 20 is used to secure the outer ends of the members 17, 18. Additional apertures are provided near the inner ends of the members 17, 18 for reception of one side of a U-bolt 21 that may be used to secure the assembly to a tubular metal fence post. In this case, a typical bracket 22 would be used having a concave rear recess 23 which fits against the outer periphery of the post. Additional tubular spacers 25 may be provided to mount the assembly as shown.

The spacer 19' has attached thereto a stop member 26 having a vertical face 27. Another set of apertures 28 is located inwardly of the outer ends of the members 17, 18, and receives the other side of the U-bolt 21 which passes through another tubular spacer 29. Nuts 30 are tightened onto the threaded ends of the U-bolt to rigidly secure the assembly to the post.

A latch ring 35 having a width slightly less than the length of the spacer 29 is pivotally mounted thereon. The length of the slot between the spacers 29 and 19' is substantially greater than its length between the spacer 19 and 29. Thus the ring 35 can pivot freely in the counter clockwise direction about the axis of the apertures 28, however the spacer 19 will engage the outer periphery of the ring at a point well above a horizontal line passing through the center of the ring to limit its pivotal rotation in the clockwise direction.

A support member 40 is secured to the frame assembly by suitable means such as a vertical bracket 39 that is welded at its upper and lower ends. The member 40 has an elongated horizontal portion 41 of substantially the same length as the distance between the spacers 29 and 19', and an inclined portion 42 that may have substantially the same length as the distance between the outer ends of the members 17, 18 and the spacer 29. The portion 42 is inclined downwardly and outwardly at a suitable angle such as about forth-five (45°) degrees. The support member 40 may be constructed out of angle iron having a vertical side 43 to produce increased rigidity.

The latch bar 13 (FIG. 4A) preferably is made of angle iron to provide a horizontal upper portion 44 and a vertical side portion 45, both of substantial width. The L-shape of the bar 13 provides increased strength to reduce the possibility of bending. The width of the upper portion 44 reduces play of the bar in the closed position, and the height prevents accidental opening as will be subsequently described.

It will be recognized that the outer spacer 19 engages the outer periphery of the ring 35 on a line that is well above a line passing through the center of the ring, and is parallel thereto. When the ring 35 is subjected to an opening force in the outward direction, the spacer 19 reacts to prevent clockwise swinging movement of the ring with a force that is directed through the center of the ring, and which is the resultant of a horizontal, inwardly directed force, and a vertical downwardly directed force. So long as the ring 35 is not subjected to an upward force which substantially exceeds the vertical component of the reaction force, the latch cannot open. Thus it is important for the latch bar 13 to have a substantial vertical height so that it will engage the outer periphery of the ring 35 at a line that is not any substantial distance below the horizontal diameter thereof. The width of the upper portion 44 of the latch bar 13 is only slightly less than the distance between the outer peripheral surface of the ring 35 at its center and the opposing face of the stop member 26. Thus arranged, there is very little play that is afforded between the latch bar 13 and the keeper assembly, and the height of the bar is such as to prevent inadvertent opening. The L-shape of the bar provides a structure which inhibits bending, all of which are highly desirable features in a rugged and foolproof gate latch assembly.

Another embodiment of the present invention is shown in FIG. 3, which illustrates a two-way latch assembly that permits a gate to open inward or outward. Since the embodiments are similar, the same reference numerals have been given to identical parts. In this embodiment, the side members 50, 51 are somewhat longer, and an inner bolt 52 and a spacer 53 are provided. The stop member of the previous embodiment is replaced by a tubular spacer 54 on which is pivotally mounted another latch ring 55. The support member 40' has an inwardly and downwardly inclined portion 56 at its inner side to provide an oppositely disposed ramp that is useful when the gate is being closed from its outer open position. The distance between the center lines of the spacers 19 and 53 is such that the upper horizontal portion of the latch bar 13 fits between the rings 35, 55 with very little play when the gate 14 is closed.

OPERATION

In operation, the keeper assembly 11 and support are mounted on the fence post 12 as shown, and the latch bar 13 is mounted on the gate 14 at the proper vertical height so that its lower edge just barely clears the upper surface of the horizontal portion 41 of the support 40 as the gate closes. As shown in FIG. 4A, normally the rings 35, 55 hang on the pivots with their adjacent outer peripheries being separated by a distance d, and their upper outer peripheries being engaged by the spacers 19 and 53. As the gate 14 is closed, the bar 13 forces the ring 55 to swing, as shown in FIG. 4B, clockwise so that the leading edge of the bar begins to engage the ring well below its center. At this point, the vertical component of the opening force lifts the ring 55 vertically upward to permit the bar 13 to pass to a location between the rings 35, 55, whereupon the lifted ring 55 falls downward and occupies its original position as shown in FIG. 4C. Since lateral movement of the bar 13, either forward or rearward, brings the limiting action of the spacers 19 and 53 into play, the gate 14 is securely latched.

To release the latching action of either embodiment of the present invention, it is only necessary for a person to use his or her finger to lift the ring member on the opening side to thereby free the latch bar 13.

Should the gate 14 sag with the passage of time, which almost always occurs irregardless of the construction thereof, the support member 40 ensures that the latch bar 13 always will be properly positioned, in the vertical sense, for proper latching action. The ramps 42, 56 aid the user in positioning the bar 13 on the horizontal portion 41 of the support.

The one-way embodiment 11 of the present invention operates in the same manner as the embodiment just described, except that the stop lug 26 limits rearward movement of the bar 13, rather than another ring.

The latch can be locked by inserting the shackle of a padlock through the apertures 60 and 61 in the bar 13 and support 40, respectively.

A number of modifications, and other uses, may be made to and of the present invention without departing from the inventive concepts embodied therein. For example, the support member 40 need not be physically attached to the keeper assembly 11 by a strap 39 as shown, provided care is exercised in attaching the support member to the post 12 a proper distance below the keeper assembly by a separate U-bolt assembly in the case of a circular post, or lag screws in the case of a square or rectangular wooden post. The latch bar 13 is shown as made out of angle iron, however the bar could be made out of square tubing. Where the latch bar 13 is attached to other types of gate constructions, the bar can be bent to an offset position prior to attachment, so as to be properly aligned. Of course it will be apparent that the mounting positions of the keeper assembly 11 and the latch bar 13 can be reversed. Where the keeper assembly 11 is attached to a wooden post as shown in FIG. 1, of course lag screws passing through the apertures 28 in the side members of the frame can be used.

Respecting uses of the present invention other than for latching gates, applicants believe that the invention could be used as a cabinet door latch that would be relatively child-proof. For this use a significant amount of play would be permitted for the latch bar 13, so that the door, which normally would be held totally closed by typical magnets or the like, could be opened a small amount before limiting takes place. An adult could then reach his or her finger in to lift the ring 35 and release the latch, however a small child would not normally have fingers sufficiently long to be able to reach the ring.

Since various changes or modifications may be made in the present invention without departing from the unique concepts involved, it is the aim of the appended claims to cover all such changes and modifications fully within the true spirit and scope of the present invention.

What is claimed is:

1. Latch apparatus for use in securing a gate or the like in a closed position, comprising: frame means including a pair of parallel, generally rectangular plate members; a pair of spacer members engaged between said plate members for holding said plate members a fixed distance apart, said spacer members each having a horizontal central axis, the said horizontal axes of said spacer members being located in the same horizontal plane; ring means pivotally carried on one of said spacer members, the other of said spacer members normally engaging the outer periphery of said ring means to provide a stop that prevents swinging movement of said ring means toward said other spacer member; latch bar means having a vertical dimension not substantially less than the mean radius dimension of said ring means; support means cooperable with said latch bar means for supporting the said latch bar means in said closed position, said support means having an upper surface that is located below the uppermost surface of said one spacer member a distance that is substantially equal to the mean diameter of said ring means; and means on said frame means for limiting movement of said latch bar means away from said ring means in said closed position.

2. The apparatus of claim 1 wherein said support means comprises an elongated member having a horizontal portion and an outer inclined portion, said inclined portion providing a ramp for aiding in lifting said latch bar means up onto said horizontal portion in the event of gate sag.

3. The apparatus of claim 1 wherein said latch bar means is constructed of angle iron having a horizontal portion and a vertical portion, said vertical portion being dimensioned to provide a height to work with said ring means, and said horizontal portion having a sufficient width to provide strength against bending and to prevent significant lateral play in the closed position.

4. The apparatus of claim 3 wherein said angle iron is adapted to be attached to a gate with the horizontal portion thereof above the vertical portion thereof.

5. The apparatus of claim 1 wherein said latch bar means and said support means are provided with apertures through which the shackle of a padlock can be inserted in the closed position to lock the gate closed.

6. The apparatus of claim 1 further including bracket means cooperatively associated with said frame means and adapted to secure said frame means to a gate post.

7. The apparatus of claim 1 wherein said limiting means includes a stop member having an outwardly directed abutment face located inwardly of said one spacer member and at a location such that the clearance between said stop member face and the adjacent outer periphery of said ring means is not substantially greater than the horizontal dimension of said latch bar means, whereby said latch apparatus permits opening of a gate only in the outward direction.

8. Latch apparatus for use in securing a gate or the like in a closed position, comprising: frame means including a pair of parallel, generally rectangular plate members; first and second pairs of spacer members engaged between said plate members for holding said plate members a fixed distance apart, each of said spacer members having a horizontal central axis, the respective horizontal axes of each of said spacer members being located in the same horizontal plane; first and second ring members respectively pivotally mounted between said plate members on the inner one of said first and second pairs of spacer members, the outer one of each pair of spacer members providing stop means normally engaging the outer periphery of an adjacent ring member for limiting swinging movement thereof toward said outer spacer member; means adapted to mount said frame means on a gate post; latch bar means having a vertical dimension not substantially less than the mean radius dimensions of said ring members and being positioned between said ring members to secure a gate in said closed position; and support means having an upper surface that is located below the uppermost surfaces of said upper pair of spacer members a vertical distance that is substantially equal to the mean diameter of at least one of said ring members and cooperable with said latch bar means for supporting the said latch bar means in said closed position.

9. The apparatus of claim 8 wherein said support means comprises an elongated member having a horizontal central portion and outer inclined portions extending in opposite directions, each of said inclined portions providing a ramp function for aiding in lifting said latch bar means up onto said horizontal central portion in the event of sag of the gate.

10. The apparatus of claim 9 wherein said support means is rigidly attached to said frame means.

11. The apparatus of claim 9 wherein said latch bar means is sized and arranged to provide a height to work with said ring members, and a width that is not substantially less than the horizontal separation of said ring members on a line passing through their respective centers, said latch bar means having strength against bending and being sized to prevent substantial play in the closed position.

12. The apparatus of claim 11 wherein said latch bar means is constructed of angle iron having a vertical portion and a horizontal portion, said bar means being adapted to be attached to a gate in a manner such that its said horizontal portion is above the said vertical portion thereof.

13. The apparatus of claim 8 further including means enabling said latch bar means to be locked to said frame means.

14. The apparatus of claim 13 wherein said enabling means includes apertures in said latch bar means and said support means arranged to receive the shackle of a padlock.

15. The apparatus of claim 8 wherein said means adapted to mount said frame means comprises a bracket having a concave recess in the rear thereof to permit said frame means to be securely mounted to a post having a circular cross-section.

16. The apparatus of claim 8 wherein said mounting means comprises aligned apertures in said plate members arranged to receive lag screws or the like to permit said frame means to be securely mounted to a post having a polyagonal cross-section.

* * * * *